United States Patent [19]

Kragle

[11] Patent Number: 4,865,254

[45] Date of Patent: Sep. 12, 1989

[54] TWO-HEAD SHOWER ARM

[76] Inventor: George D. Kragle, 10006 Woodrow St., Vienna, Va. 22180

[21] Appl. No.: 218,851

[22] Filed: Jul. 14, 1988

Related U.S. Application Data

[63] Continuation-in-part of Ser. No. 60,763, Jun. 9, 1987, abandoned.

[51] Int. Cl.[4] ..... B05B 12/00

[52] U.S. Cl. ..... 239/76; 239/550; 239/565; 137/861; 137/883; 4/601; 285/159

[58] Field of Search ..... 239/565, 566, 76, 550, 239/548, 565, 566, 230, 276; 137/861, 883, 801; 4/596, 601; 285/155

[56] References Cited

U.S. PATENT DOCUMENTS

| | | | |
|---|---|---|---|
| 725,275 | 4/1903 | McLean | 285/155 X |
| 1,130,520 | 3/1915 | Kenney | 4/601 |
| 1,207,380 | 12/1916 | Duffy | 4/601 |
| 1,241,032 | 9/1917 | Schneider | 239/565 |
| 2,622,610 | 12/1952 | Rowe et al. | 239/76 |
| 2,755,851 | 7/1956 | Dow et al. | 239/566 |
| 3,822,826 | 7/1974 | Wilson | 239/267 |
| 4,176,791 | 12/1979 | Cattaneo et al. | 239/76 |
| 4,423,838 | 1/1984 | Dinur | 239/76 |
| 4,709,947 | 12/1987 | Kniess | 285/155 X |

FOREIGN PATENT DOCUMENTS 7221555 1/1973 France .

*Primary Examiner*—Andres Kashnikow
*Assistant Examiner*—Christopher G. Trainor
*Attorney, Agent, or Firm*—Walter F. Wessendorf, Jr.

[57] ABSTRACT

A two-head shower arm, of integral, one-piece construction, having a rectilinear, straight pipe and upstream and downstream depending pipe portions, all having the same inside diameters and possessing the inherent and self-contained functional attributes and qualities of substantially the same volumetric water discharges from both depending pipe portions, without recirculation, surge or hammer; and adapted for free-standing cantilever mounting relationship with an existing water supply outlet fitting in a shower enclosure's vertical side wall to dispose thereby shower heads carried by the depending pipe portions in the same horizontal plane in normal relationship with the vertical side wall.

7 Claims, 5 Drawing Sheets

TWO-HEAD SHOWER ARM

REFERENCE TO PENDING APPLICATION

This application is a continuation-in-part of my pending United States utility patent application, Ser. No. 060/763, filed 06/09/87, now abandoned, with respect to which priority is hereby claimed.

BACKGROUND OF THE INVENTION

1. Technical Field

This invention relates to a two-head shower arm, of integral, one-piece construction, for free-standing cantilever mounting with a shower side wall outlet fitting for horizontal disposition with respect to such shower side wall, and with the shower arm possessing the inherent and self-contained quality of the same or substantially the same volumetric discharges of water from both its depending pipe portions, without recirculation, surge or hammer.

2. Background

The problem in the art to which this invention apertains is the need for a rigid two-head shower arm, of integral, one-piece construction, for fixed free-standing cantilever mounting with respect to an existing female-threaded water supply outlet fitting, to mount two shower heads in the same horizontal plane to deliver the same or substantially the same volumetric discharges of water from both shower heads, without recirculation, surge or hammer, to thereby spray a bather more completely and equally thus making it more relaxing and enjoyable for the bather taking a shower. An existing, one-head shower arm mounts only one shower head with the undesirable result that warm or cool water will not completely cover the bather, but will spray only such bather's head or shoulders or bath at one time. However, with two shower heads discharging the same or substantially the same quantities of water, the spraying shower water will completely cover the bather's head, shoulders and back at the same time. The fixed mounting, in free-standing cantilever relationship of a twohead shower arm with a shower side wall outlet fitting for disposition of the shower heads in the same horizontal plane is not countenanced in the prior art; and likewise not countenanced in the prior art is such a two-head shower arm possessing the inherent and self-contained quality of discharging the same or substantially the same amounts of water from both its depending pipe portions at the same time. In the past, a rigid conduit pipe carrying two opposed shower heads, fixedly mounted at its upstream end with an existing female water supply outlet fitting and frictionally engaged at its downstream end against the opposite wall of the shower recess or enclosure has been attempted; however, the volumetric discharges from the two opposed shower heads are substantially different because the corresponding head losses are substantially different, besides the problems of recirculation, surge and possibly hammer.

SUMMARY OF THE INVENTION

Accordingly, the objects of the invention are to contribute to the solution of the discussed problems of the art by providing a two-head shower arm of integral, one-piece construction, mounting two shower heads. The two-head shower arm has the male-threaded upstream end of its rectilinear, straight pipe fixedly mounted in free-standing cantilever relationship with respect to a conventional female-threaded water supply outlet fitting in a shower enclosure's vertical side wall. Such rectilinear, straight pipe is thusly disposed in a horizontal plane in normal relationship to such vertical side wall of such tube or shower. Upstream and downstream depending straight pipe portions have 45° angles of incidence with the rectilinear, straight pipe, and intermediate radius-curved pipe portions join the depending straight pipe portions with the rectilinear, straight pipe. In one embodiment of the invention, the inside diameters of the rectilinear, straight pipe and the two depending straight pipe portions are the same with the result that volumetric water discharge from the upstream depending straight pipe portion is less than 55%, while volumetric water discharge from the depending straight pipe portion is more than 45% with no recirculation, surge or hammer. In the other embodiment of the invention, the inside diameters of the rectilinear, straight pipe and the downstream depending straight pipe portion are the same, while the inside diameter of the upstream depending straight pipe portion is slightly less with the result that volumetric water discharges from both the upstream and downstream depending straight pipe portions are uniform and the same, with no recirculation, surge or hammer. Both invention embodiments possess the inherent and self-contained functional attributes and qualities, as described, of having the same, or substantially the same, uniform volumetric water discharges from their upstream and downstream depending straight pipe portions.

BRIEF DESCRIPTION OF THE DRAWINGS

These objects and other objects of the invention should be discerned and appreciated from the detailed description taken in conjunction with the drawings wherein like reference numerals refer to similar parts throughout the several views, in which.

DESCRIPTION OF THE PREFERRED EMBODIMENT

Figure 1:
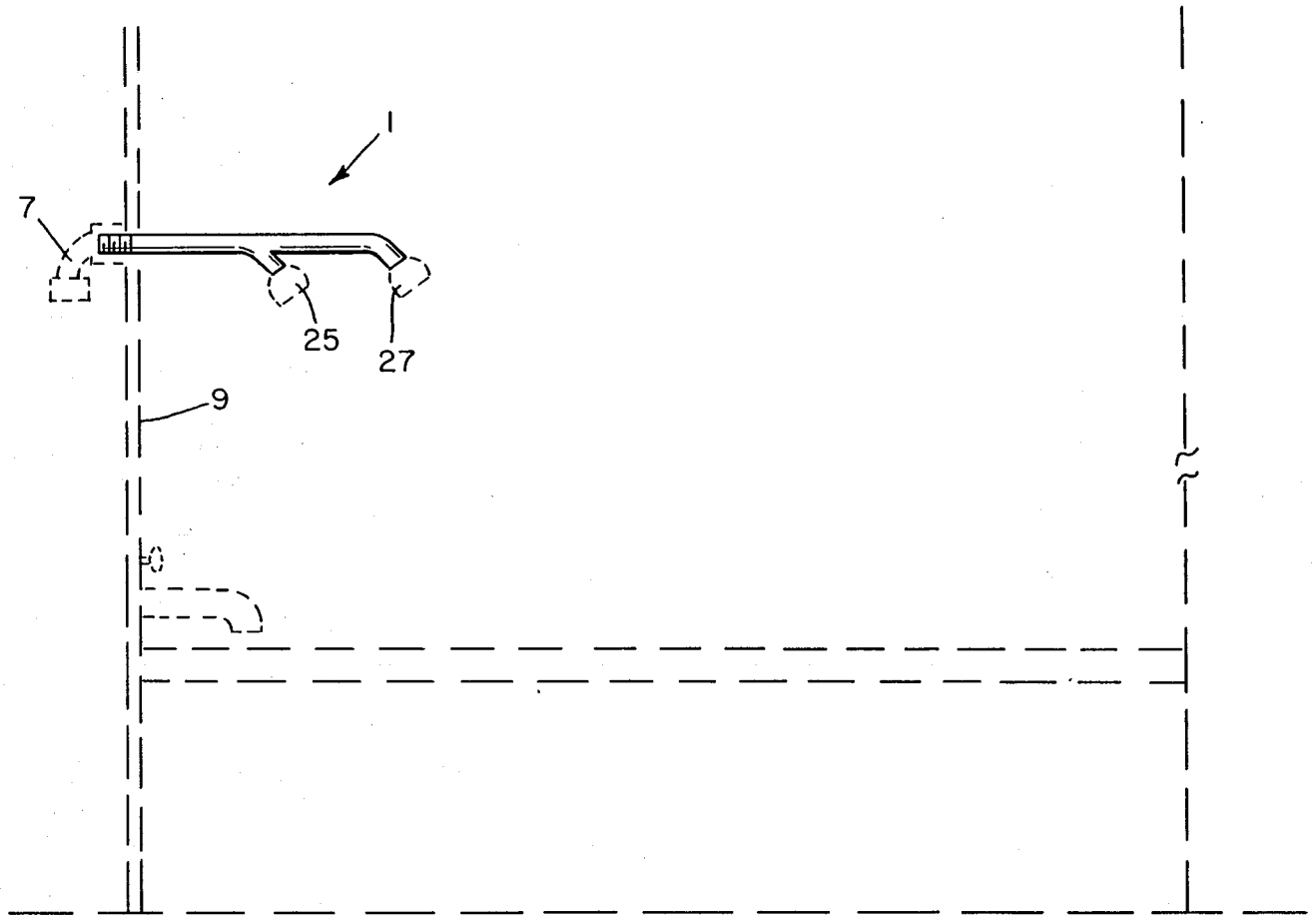
FIG. 1 shows the two-head shower arm in fixedly threaded engagement, in free-standing cantilever relationship, with a female-threaded water supply outlet fitting in a vertical side wall of a shower enclosure.
Figure 3:
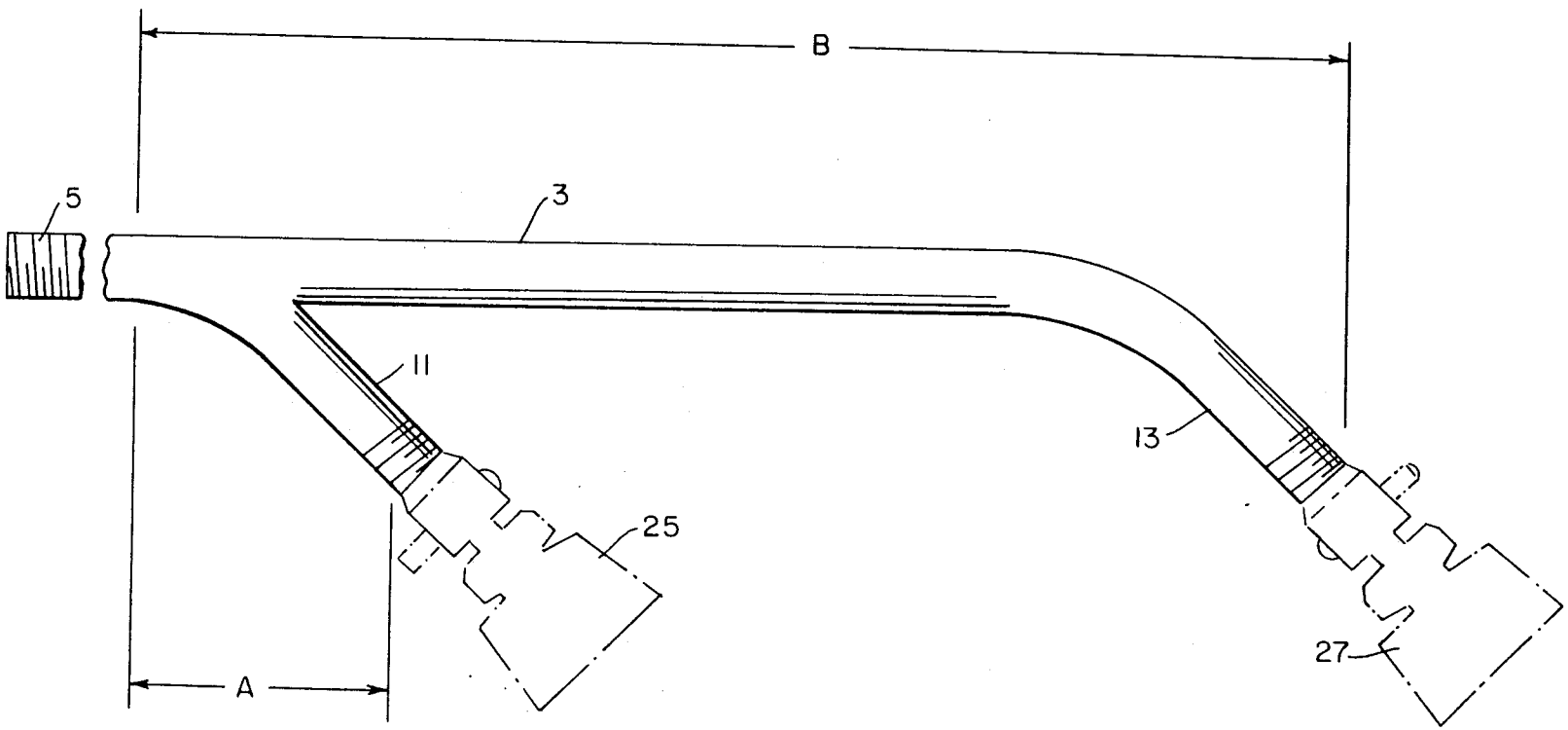
FIG. 3 is a representational view of the first invention embodiment, shown in FIG. 2, indicating the relative head losses.

In FIG. 1 of the drawings, reference numeral 1 generally refers to the two-head shower arm. Shower arm 1 is made of brass or of other suitable material and is of integral, one-piece construction. Shower arm 1 has a rectilinear, straight pipe 3 and a male-threaded upstream end 5 fixedly mounted in freestanding cantilever relationship with a conventional female-threaded water supply outlet fitting 7 in a shower enclosure's vertical side wall 9. Upstream and downstream depending straight pipe portions 11 and 13 have 45° angles of incidence relative to the rectilinear, straight pipe 3. The upstream pipe portion 11 is adjacent the upstream end 5 of straight pipe 3. Shower arm 1 has an upstream radius-curved pipe portion 15 that joins together, in communicative relationship, the straight pipe 3 and the upstream depending pipe portion 11. Shower arm 1 has a downstream radius-curved pipe portion 17 that joins together, in communicative relationship, the downstream end 19 of straight pipe 3 with the downstream depending pipe portion 13. The upstream and downstream pipe portions 11 and 13 have respective male-threaded ends 21 and 23 which mount conventional femalethreaded shower heads 25 and 27, respectively. Such fixed mounting of the upstream end 5 with the water supply outlet fitting 7 disposes straight pipe 3 in one horizontal plane in normal relationship with the vertical side wall 9 and correspondingly disposes the shower heads 25 and 27 in a second horizontal plane in normal relationship with vertical side wall 9. The straight pipe 3 and the upstream and downstream pipe portions 11 and 13 have inside diameters of ½" with the result that volumetric water discharge from upstream pipe portion 11 is less than 55% and the volumetric water discharge from downstream pipe portion 13 is more than 45%; or, as represented in FIG. 3, head loss B is slightly greater than head loss A, without recirculation, surge or hammer. Thus it can be said that shower arm 1 possesses the inherent and self-contained functional attribute and quality of having substantially the same, uniform volumetric water discharges from both the upstream and downstream pipe portions 11 and 13 and hence from their respective shower heads 25 and 27. Such inherent and self-contained functional attributes and qualities, as described, together with the described structure, arrangement and disposition of shower arm 1, results in shower water spraying a bather's head, shoulders and back at the same time more completely and equally, thus making it more relaxing and enjoyable for the bather taking a shower.

Figure 2:
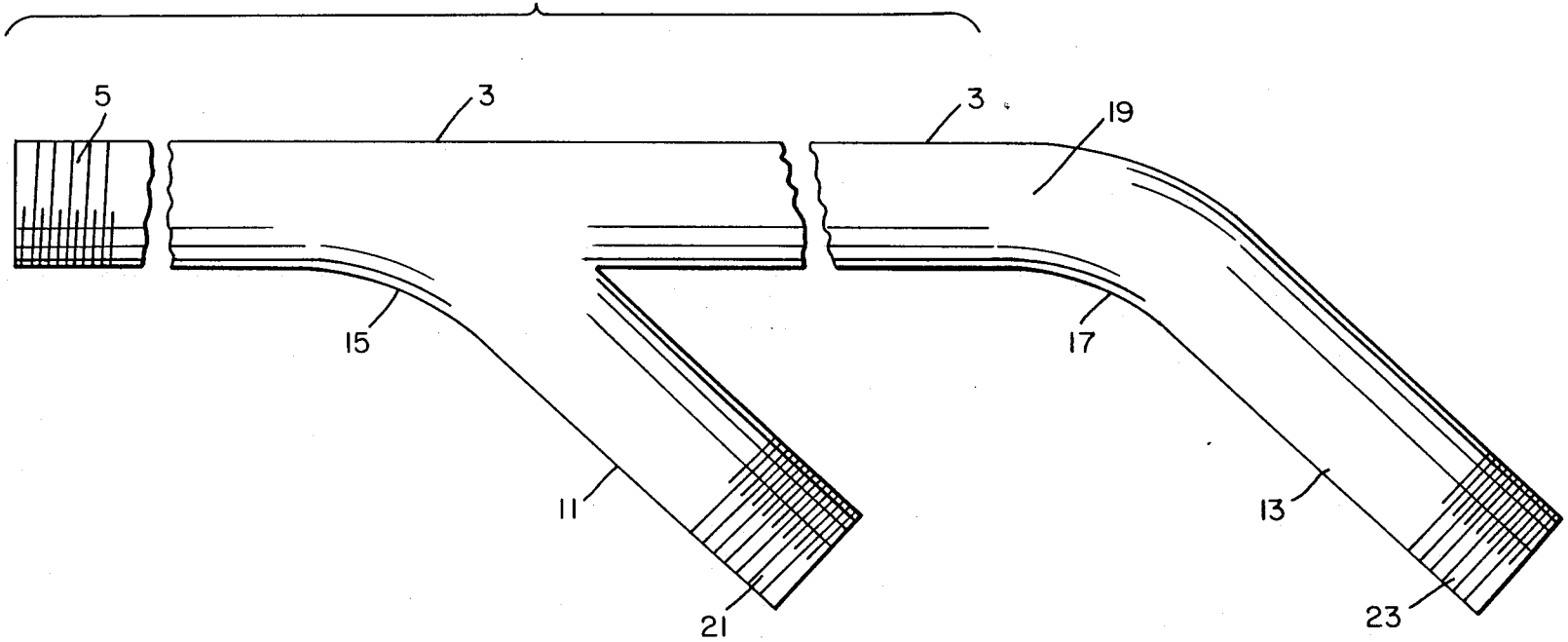
FIG. 2 shows a blown-up view of the first embodiment of the two-head shower arm with the rectilinear, straight pipe broken-away.
Figure 4:
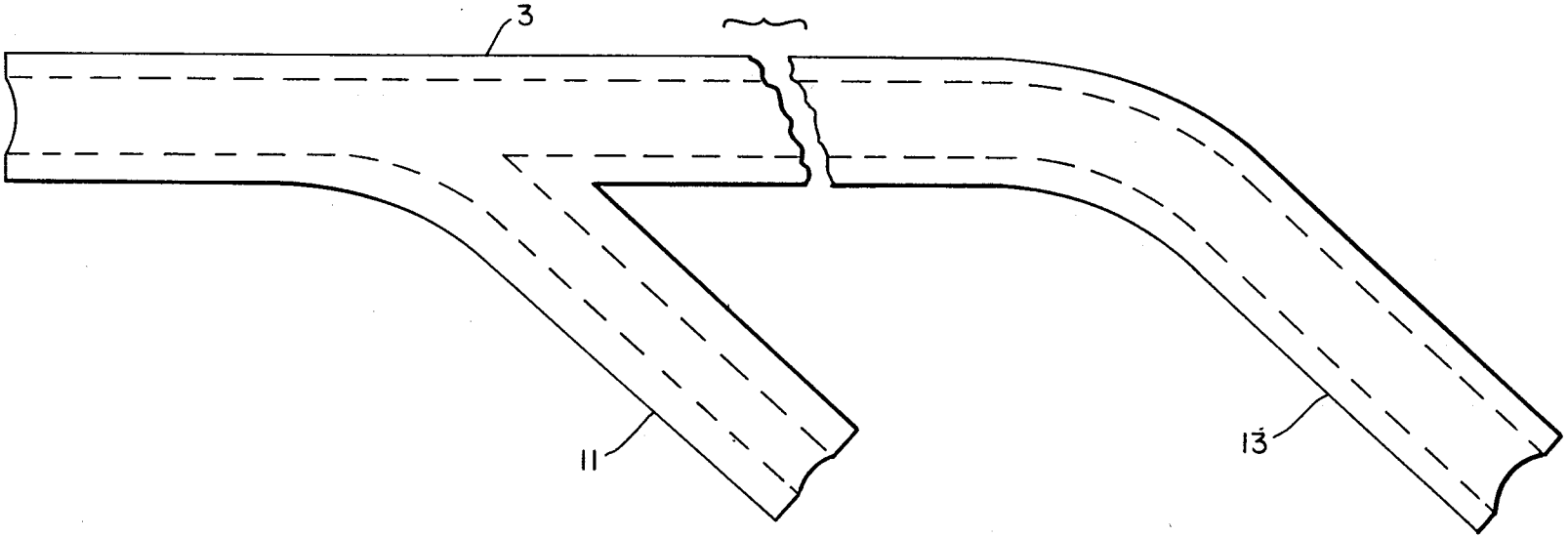
FIG. 4 shows a blown-up view of the second embodiment of the two-head shower arm with the rectilinear, straight pipe broken-away and with the wall thicknesses of the rectilinear, straight pipe and the upstream and downstream depending straight pipe portions exaggerated.
Figure 5:
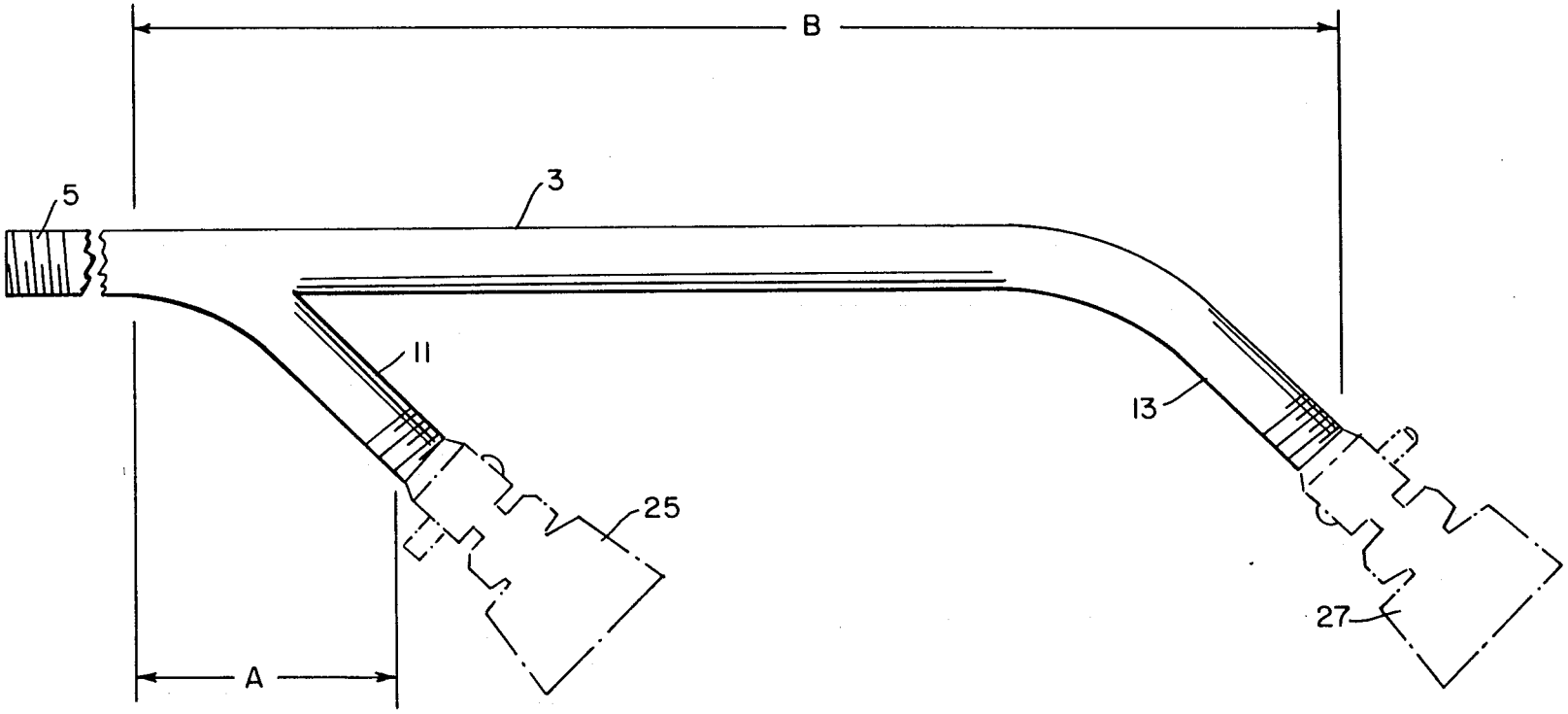
FIG. 5 is a representational view of the second invention embodiment, shown in FIG. 4, indicating the relative head losses.

The second embodiment of the invention, shown in FIG. 4, differs structurally from the first embodiment of the invention, described with reference to FIGS. 1, 2 and 3, only in that the inside diameter of the upstream depending pipe portion 11 is slightly less than the equal inside diameters of the straight pipe 3 and the downstream depending pipe portion 13 with the result that head loss A is equal to head loss B, as represented in FIG. 5, resulting in the volumetric water discharges from the upstream and downstream pipe portions 11 and 13 being uniform and the same.

I claim:

1. A two-head shower arm comprising a rectilinear, straight pipe, and upstream and downstream depending pipe portions, and with said shower arm inherently having substantially the same volumetric water discharges from both its said upstream and downstream depending pipe portions without recirculation, surge or hammer; said two-head shower arm being of integral, one-piece construction, said upstream and downstream depending pipe portions being in parallel relationship and having the same acute angles of incidence relative to said rectilinear, straight pipe, said rectilinear, straight pipe having an upstream end, said upstream end of said rectilinear, straight pipe being male-threaded and being adapted for fixedly threaded engagement, in free-standing relationship, with a female-threaded water supply outlet fitting in a side wall of a shower enclosure to dispose said rectilinear, straight pipe in a horizontal plane with said upstream and downstream depending pipe portions being oriented and disposed in a direction away from said upstream end of said rectilinear, straight pipe, said upstream depending pipe portion being immediately adjacent to said upstream end of said rectilinear, straight pipe, said upstream depending pipe portion and said rectilinear, straight pipe being in communicative relationship and having a common junction, said common junction of said upstream depending pipe portion and said rectilinear, straight pipe being in radius-curved relationship, said rectilinear, straight pipe continuing to and terminating in said downstream depending pipe portion, said downstream depending pipe portion and said rectilinear, straight pipe being in communicative relationship and having a common junction, said common junction of said downstream depending pipe portion and said rectilinear, straight pipe being in radius-curved relationship, said rectilinear, straight pipe and said upstream and downstream depending pipe portions all having the same inside diameters.

2. A two-head shower arm in accordance with claim 1, wherein said acute angles of incidence of said upstream and downstream depending pipe portions are approximately 45°.

3. A two-head shower arm in accordance with claim 1, wherein said upstream and downstream depending pipe portions have male-threaded ends adapted for mounting shower heads.

4. A two-head shower arm in accordance with claim 1, wherein said rectilinear, straight pipe, and said upstream and downstream depending pipe portions, all having inside diameters of ½", wherein the volumetric discharge of water from said upstream depending pipe portion is less than 55%, and wherein the volumetric discharge of water from said downstream depending pipe portion is more than 45%.

5. A two-head shower arm comprising a rectilinear, straight pipe, and upstream and downstream depending pipe portions, and with said shower arm having the equal volumetric water discharges from both its upstream and downstream depending pipe portions without recirculation, surge or hammer; said two-head shower arm being of integral, one-piece construction, said upstream and downstream depending pipe portions being in parallel relationship and having the same acute angles of incidence relative to said rectilinear, straight pipe, said rectilinear, straight pipe having an upstream end, said upstream end of said rectilinear, straight pipe being male-threaded and being adapted for fixedly threaded engagement, in free-standing relationship, with a female-threaded water supply outlet fitting in a side wall of a shower enclosure to dispose said rectilinear, straight pipe in a horizontal plane with said upstream and downstream depending pipe portions being oriented and disposed in a direction away from said upstream end of said rectilinear, straight pipe, said upstream depending pipe portion being immediately adjacent to said upstream end of said rectilinear, straight pipe, said upstream depending pipe portion and said rectilinear, straight pipe being in communicative relationship and having a common junction, said common junction of said upstream depending pipe portion and said rectilinear, straight pipe being in radius-curved relationship, said rectilinear, straight pipe continuing to and terminating in said downstream depending pipe portion, said downstream depending pipe portion and said rectilinear, straight pipe being in communicative relationship and having a common junction, said common junction of said downstream depending pipe portion and said rectilinear, straight pipe being in radius-curved relationship, said rectilinear, straight pipe and said downstream depending pipe portion having the same inside diameters, and said upstream depending pipe portion having an inside diameter sufficiently less than the inside diameter of said rectilinear, straight pipe and downstream depending pipe portion such that the volumetric water discharges from said upstream and downstream depending pipe portions are equal.

6. A two-head shower arm in accordance with claim 5, wherein said acute angles of incidence of said upstream and downstream depending pipe portions are approximately 45°.

7. A two-head shower arm in accordance with claim 5, wherein said upstream and downstream depending pipe portions have male-threaded ends adapted for mounting shower heads.

* * * * *